United States Patent [19]

Meckstroth

[11] 3,945,500

[45] Mar. 23, 1976

[54] NECKTIE HANGER

[76] Inventor: Alan F. Meckstroth, 2357 Shelterwood Drive, Dayton, Ohio 45409

[22] Filed: Dec. 16, 1974

[21] Appl. No.: 533,306

[52] U.S. Cl. ..... 211/113; 211/13; 223/DIG. 1

[51] Int. Cl.[2] ..... A47J 51/24

[58] Field of Search ..... 211/13, 89, 87, 113; 223/87, DIG. 1

[56] References Cited

UNITED STATES PATENTS

| | | | |
|---|---|---|---|
| 2,077,316 | 4/1937 | Geib | 211/87 |
| 2,492,226 | 12/1949 | Kohl et al. | 211/89 |
| 3,081,881 | 3/1963 | Seeger | 211/13 |
| 3,592,343 | 7/1971 | Swett et al. | 211/13 |
| 3,705,653 | 12/1972 | Pereyra | 211/13 |
| 3,783,995 | 1/1974 | Tobin | 211/89 X |
| 3,790,045 | 2/1974 | Rigel et al. | 211/13 X |

*Primary Examiner*—Roy D. Frazier
*Assistant Examiner*—Robert W. Gibson, Jr.

[57] ABSTRACT

A generally flat panel of semi-rigid plastics material has a plurality of horizontally spaced inclined columns each of which supports a set of vertically spaced and cantileveredly projecting horizontal tie support bars disposed in an inclined row. The support columns are integrally connected by frame members, and an integral hook portion projects upwardly and in the same horizontal direction as the tie bars for receiving a clothes support rod within a closet. Each of the tie support bars is connected to its corresponding support column by a vertical integral hinge so that vertically adjacent tie support bars may be pivoted to opposite sides of the panel to provide for a complete display of the neckties and for convenient selection and return of the neckties.

5 Claims, 4 Drawing Figures

NECKTIE HANGER

BACKGROUND OF THE INVENTION

There have been numerous necktie or tie racks and hangers either proposed or used for supporting a number of neckties within a clothes closet. Many of the racks are designed for mounting on a vertical surface such as the inner surface of a swinging closet door. However, when the closet is equipped with sliding or bifold doors, it is common to use some type of hanger which is suspended from the horizontal clothes rod within the closet. For example, U.S. Pat. Nos. 2,492,226 and 2,626,735 disclose two different forms of suspended necktie hangers which are adapted to be constructed from an inexpensive cardboard material. Other forms of suspended necktie hangers have been constructed entirely of wire.

In the construction of any type of necktie hanger which is suspended from the clothes support rod within a closet, it is highly desirable for the hanger to display each tie for easy selection and also to separate and position the ties so that each tie may be conveniently removed and returned without disturbing the other ties. It is also desirable to support a number of neckties within a laterally compact space so that a hanger filled with neckties does not occupy substantial longitudinal space along the clothes support rod. Furthermore, it is desirable for the tie hanger to be made for easy sliding movement along the clothes support rod and to position the ties generally in a plane extending perpendicular to the clothes support rod so that the ties are not folded and creased when the tie hanger and other garments are moved along the clothes support rod. It is apparent after using or studying the presently known tie hangers that none of them provides all of the above mentioned desirable features.

SUMMARY OF THE INVENTION

The present invention is directed to an improved hanger which is particularly adapted for use on a closet support rod for supporting and retaining a number of neckties in a manner which provides all of the desirable features mentioned above. That is, the necktie hanger of the invention provides for displaying a group of ties within a compact space and for supporting the ties in a manner so that each individual tie may be easily selected for removal and also easily returned after use. The necktie hanger also has substantial durability and is inexpensive in construction in addition to being adapted for automatic production either with use of a plastics injection molding machine or by die cutting and scoring a sheet of semi-rigid plastics material or other sheet material.

In general, the tie hanger of the invention incorporates a plurality of horizontally spaced inclined columns each of which supports a plurality or set of vertically spaced tie support bars which are also arranged in an inclined row. The upper and lower ends of the inclined columns are integrally connected by corresponding frame members which are, in turn, integrally connected by a forward end frame member. Each tie support bar projects cantileveredly from its corresponding support column and is connected to the column by a vertically extending integral hinge so that the tie support bar may be pivoted to one or either side of the hanger.

Other features and advantages of the invention will be apparent from the following description, the accompanying drawing and the appended claims.

DESCRIPTION OF THE PREFERRED EMBODIMENT

Figure 1:
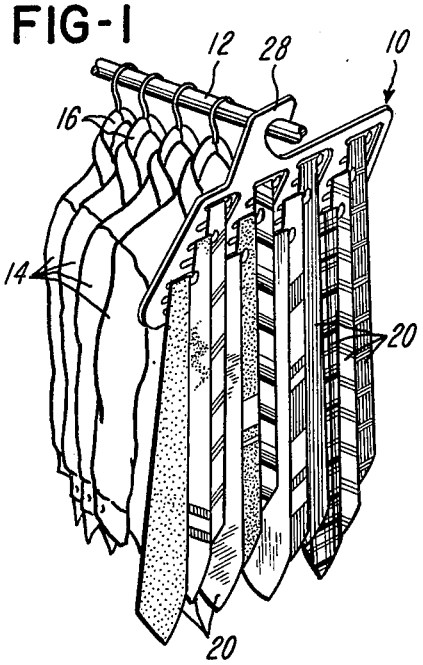
FIG. 1 is a perspective view of a necktie hanger constructed in accordance with the invention and illustrating its use on a clothes rod for supporting and displaying a number of neckties.

FIG. 1 illustrates a necktie hanger 10 which is constructed in accordance with the invention and which is supported by a clothes rod 12 within a closet between other clothing garments such as several shirts 14 supported by convention hangers 16. As illustrated, the hanger 10 is constructed to support 24 individual neckties, 12 on each side of the hanger.

Figure 2:
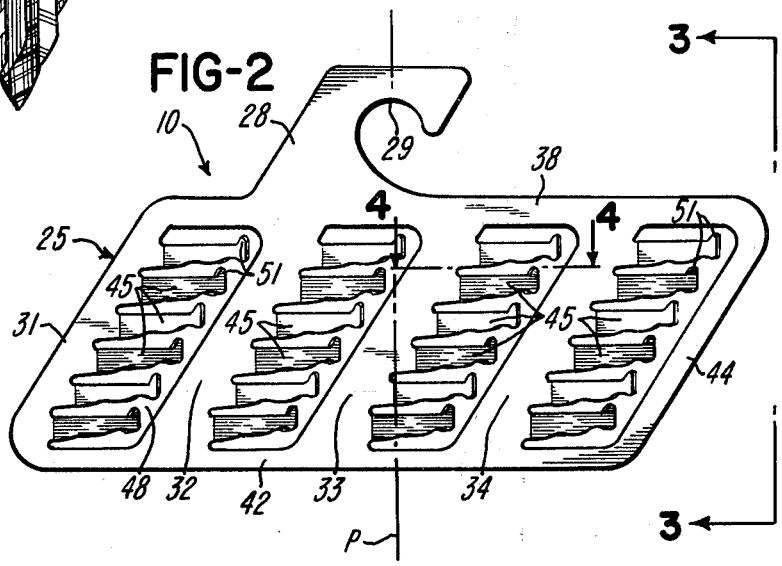
FIG. 2 is a side view of the necktie hanger shown in FIG. 1 and showing the preferred arrangement and positions of the tie support bars.
Figure 3:
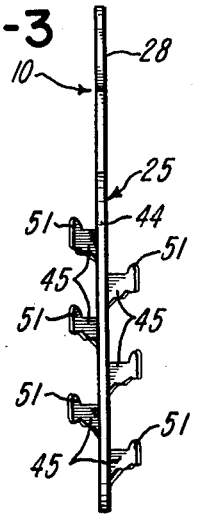
FIG. 3 is a slightly enlarged end view taken generally on the line 3—3 of FIG. 2.
Figure 4:
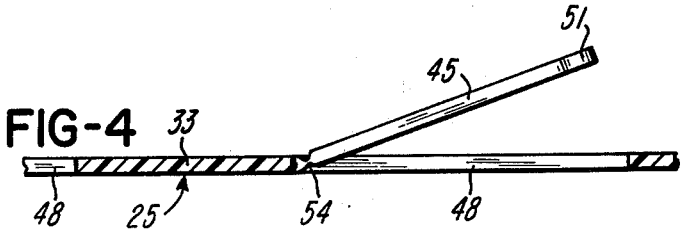
FIG. 4 is a substantially full size fragmentary section taken generally on the line 4—4 of FIG. 2.

Referring to FIGS. 2–4, the necktie hanger 10 of the invention includes a generally flat panel 25 which is adapted to be die cut from a sheet of thermoplastics material such as polyethylene or polypropylene. The panel 25 has a generally parallelogram exterior configuration, and a hook portion or member projects upwardly from the panel 25 for engaging the clothes rod 12. The hook portion or member 28 is die cut from the sheet of plastics material when the panel 25 is die cut so that the panel 25 and hook member 28 are integrally connected. The hook member 28 also has a generally parallelogram external configuration, and the center or axis of the part-circular recess 29 is disposed within a vertical plane P which extends through the center of gravity of the hanger 10.

The panel 25 includes a series of horizontally spaced inclined columns 31, 32, 33 and 34 which are inclined at an angle of approximately 33° relative to the vertical plane P. The upper portions of the inclined columns 31 – 34 are integrally connected by an upper frame or head portion 38, and the lower portions of the columns 31 – 34 are integrally connected by a lower frame or base portion 42. The forward ends of the head portion 38 and the base portion 42 are integrally connected by an end column or frame portion 44 which is inclined at the same angle as the columns 31–34. The additional weight added to the forward end portion of the hanger by the end frame portion 44 is counter balanced relative to the vertical center plane P by the additional mass of the hook member 28 on the opposite side of the center plane and the narrower width of the inclined column 31 relative to the corresponding width of the columns 32–34.

Each of the inclined support columns 31– 34 supports a plurality or set of six tie support bars 45 which project horizontally in a cantilevered manner into a corresponding opening 48 which is defined between the adjacent columns. Each of the tapered tie bars 45 includes an upwardly projecting tip portion 51 and is connected to the corresponding support column by a vertically extending integral hinge 54 (FIG. 4) formed by a thin web of the panel 25. The leg-shaped configuration of each tie bar 45 is only for ornamental purposes.

As illustrated in FIG. 3, the integral hinges 54 provide for flexing or pivoting the tie bars 45 to opposite sides of the hanger 10 while maintaining a high strength connection between each tie bar and its support column. Preferably, the adjacent horizontal rows of tie bars 45 are pivoted to opposite sides of the hanger (FIG. 3) so that the tie bars of each inclined set project in an alternating manner to opposite sides of the hanger. Each tie bar 45 is pivoted to an angle of between 20° and 45° (FIG. 4) relative to the plane of the support columns 31–34. As is also apparent from FIGS. 1 and 2, the tie bars 45 project in the same direction as the hook member 28, that is, towards the front of the hanger 10 which is adjacent the inner or rear wall of the closet. This arrangement and angles of the tie bars 45 provide for displaying each tie for convenient viewing and selection from the front of the closet.

As mentioned above, the inclined arrangement of each set of vertically spaced tie bars 45 relative to the vertical center plane P and the angular positions of the tie bars cooperate not only to provide a complete display of the ties 20 but also provide for conveniently removing a selected tie and are turning the tie without disturbing the adjacent ties. The group of neckties 20 are also supported generally within a plane normal or perpendicular to the clothes rod 12 so that when the hanger 10 and other clothing articles are shifted or slid longitudinally along the rod 12, the neckties are not creased as the group of ties are pressed between articles of clothing. Moreover, the pivotal tie bars 45 cooperate with the openings 48 to permit the ties to be compacted or pressed into a space only slightly greater than the thickness of the hanger 10.

As also mentioned above, the tie hanger is adapted to be die cut from a sheet of thermoplastics material of uniform thickness, and the integral web hinges 54 are adapted to be formed by corresponding heated scoring blades. This method of producton minimizes the cost of tooling for producing the tie hanger 10. However, it is also within the scope of the invention to form the tie hanger 10 within a single or multiple cavity mold which is supplied with fluid plastics material from an injection molding machine.

While the form of necktie hanger herein described constitutes a preferred embodiment of the invention, it is to be understood that the invention is not limited to this precise form of hanger, and that changes may be made therein without departing from the scope and spirit of the invention as defined in the appended claims.

The invention having thus been described, the following is claimed:

1. An improved hanger for neckties, comprising a generally flat body of semi-rigid material, a plurality of horizontally spaced inclined support columns disposed in substantially parallel relation and defining horizontally spaced inclined openings therebetween, a set of vertically spaced tie support bars projecting cantileveredly and horizontally from each of said columns generally into the adjacent said opening, said sets of tie support bars being arranged in a plurality of substantially parallel rows inclined in the same direction, frame means integrally connecting the corresponding upper and lower portions of said support columns, a hook member projecting upwardly from said frame means and adapted to engage a clothes rod within a closet, a substantially vertical thin web hinge integrally connecting each of said tie support bars to the corresponding said column, said hinges for said sets of tie support bars being arranged in a plurality of substantially parallel rows inclined in the same direction, a first plurality of said tie support bars in each said inclined row of bars projecting angularly outwardly from one side of said body, a second plurality of said tie support bars in each said inclined row projecting angularly outwardly from the other side of said body, and each said opening providing for open space between adjacent tie support bars in each said inclined row to facilitate convenient removal and return of each necktie.

2. A hanger as defined in claim 1 wherein said tie support bars in each inclined row project to opposite sides of said body in an alternating manner.

3. A hanger as defined in claim 1 wherein said frame means includes a lower base portion integrally connecting the lower portions of said inclined support columns and an upper head portion integrally connecting the upper portions of said columns, and an inclined end portion integrally connecting said base and head portions.

4. A hanger as defined in claim 1 wherein said body has a lower portion with a generally parallelogram external configuration, and said hook member is formed as an integral portion of said body.

5. A hanger as defined in claim 4 wherein said hook portion also has a generally parallelogram external configuration.

* * * * *